US007934535B2

(12) United States Patent
Kountis et al.

(10) Patent No.: US 7,934,535 B2
(45) Date of Patent: May 3, 2011

(54) CENTRIFUGE CASTING DEVICE

(76) Inventors: Demetrios Kountis, Akron, OH (US); James Hedderly, Akron, OH (US)

( * ) Notice: Subject to any disclaimer, the term of this patent is extended or adjusted under 35 U.S.C. 154(b) by 0 days.

(21) Appl. No.: 12/615,029

(22) Filed: Nov. 9, 2009

(65) Prior Publication Data

US 2010/0116454 A1 May 13, 2010

Related U.S. Application Data

(63) Continuation of application No. 11/439,402, filed on May 23, 2006, now abandoned.

(60) Provisional application No. 60/774,690, filed on Feb. 17, 2006.

(51) Int. Cl.
*B22D 13/06* (2006.01)

(52) U.S. Cl. ..... 164/289; 164/114

(58) Field of Classification Search ..... 164/286–297, 164/114–118

See application file for complete search history.

(56) References Cited

U.S. PATENT DOCUMENTS

| | | | | |
|---|---|---|---|---|
| 2,085,394 | A | 6/1937 | Sargent | |
| 3,938,928 | A | 2/1976 | Andrews | |
| 4,077,460 | A * | 3/1978 | Halatek | 164/152 |
| 4,134,445 | A | 1/1979 | Goodrich et al. | |
| 4,273,181 | A | 6/1981 | Winer | |
| 4,519,971 | A | 5/1985 | Schaer | |
| 4,527,610 | A | 7/1985 | Krebser et al. | |
| 4,729,780 | A | 3/1988 | Shimizu | |
| 5,337,804 | A | 8/1994 | Berger et al. | |
| 5,860,468 | A | 1/1999 | Cook | |

FOREIGN PATENT DOCUMENTS

| | | |
|---|---|---|
| BE | 367744 | 2/1930 |

OTHER PUBLICATIONS

International Search Report, 3 pages, Oct. 12, 2007.

* cited by examiner

*Primary Examiner* — Kuang Lin

(74) *Attorney, Agent, or Firm* — Brouse McDowell; John M. Skeriotis

(57) ABSTRACT

A centrifugal casting method and apparatus for casting molten metal into a mold. The casting apparatus includes a housing provided with a bottom surface and a retaining wall for minimizing a number of projectiles that escape the housing during casting operations. A prime mover is provided for imparting a centrifugal force on the molten metal, and an arm is coupled to the prime mover adjacent to a proximate end to be rotated about a rotational axis and to support a cradle for receiving the mold adjacent to a distal end. A crucible is to be coupled to the arm for supporting the molten metal to be cast into the mold, while a catch surface is disposed between the arm and the bottom surface of the housing to collect molten metal that is cast but not received within the mold.

1 Claim, 10 Drawing Sheets

CENTRIFUGE CASTING DEVICE

CROSS-REFERENCE TO RELATED APPLICATIONS

This application claims the benefit of U.S. application Ser. No. 11/439,402, filed on May 23, 2006. U.S. application Ser. No. 11/439,402 claimed the benefit of U.S. Provisional Application No. 60/774,690, filed on Feb. 17, 2006.

BACKGROUND OF THE INVENTION

1. Field of the Invention

The present invention is directed generally to a casting device and method, and more specifically to a dental casting device for creating a dental prosthesis with efficient metal recovery and harmful-vapor minimization.

2. Description of Related Art

It is well-known that high-purity precious metals are used in the formation of prosthetic dental pieces. Traditionally, a mold of the desired dental impression was inserted into a mold along with an amount of the precious metal to be cast into a crucible. The precious metal was subjected to high temperatures allowing the metal to melt while the centrifugal force imparted thereon forced it into the mold, thereby creating the dental piece.

Such a centrifugal casting machine was required to rotate the molten metal and the mold at a high angular velocity to adequately fill the mold with the molten metal. This was typically accomplished by rotating an arm holding the metal and the mold within a cylindrical container such as a drum. The walls of the drum acted as a safety measure to minimize the number of articles cast outside of the drum possibly a bystander during rotation of the mold and the metal. However, for convenience, the assembly comprising the arm that was rotated was elevated above the bottom of the drum at a convenient working height for the operator. This left a significant void between the rotational arm of the casting machine and the bottom of the drum.

During a typical casting operation, it was common for at least a portion of the precious metal to miss the mold due to the high angular velocity at which the arm assembly was rotating. These trace amounts, typically no more than fractions of an ounce, are cooled while they are cast in a radially-outward direction towards the wall of the drum, and are typically at least partially solidified by the time they reach that wall. As such, upon impacting the sidewall of the drum, the particular precious metal falls through the void between the bottom of the drum and the rotational arm and eventually comes to rest at the bottom of the drum. For precious metals such as gold, platinum, and titanium that are expensive, the loss of even trace amounts of these metals over a prolonged period of time can amount to significant losses to the proprietor.

In addition to problems associated with costs due to lost metals, the casting environment also poses a risk to the health of an operator standing close to the machine. The high temperatures required to melt the precious metals to be used in the dental prosthesis tend to vaporize potentially toxic impurities found on the crucible used to melt the metal, the mold in which the dental prosthesis is cast, and other materials involved in the casting process. Vaporization of these potentially toxic materials requires safety measures to minimize the amount of toxic materials inhaled by the operator.

Yet other environmental hazards exist in the dental casting process. For instance, the high angular velocity at which the arm supporting the mold must rotate poses a threat to limbs of the operator coming into contact with the arm. Further, conventional casting machines often require the operator to manually wind the arm in one direction to load a spring that recoils to rotate the arm in the opposite direction at a high angular velocity. Again, this requires the operator to make physical contact with the arm immediately prior to the arm reaching a high angular velocity.

Accordingly, there is a need in the art for a dental casting machine that makes efficient use of precious metals, and minimizes potentially harmful environmental hazards to which an operator is exposed.

BRIEF SUMMARY OF THE INVENTION

According to one aspect, the present invention provides a centrifugal casting apparatus for casting molten metal into a mold, the casting apparatus comprising a housing comprising a bottom surface, and a retaining wall for minimizing a number of projectiles that escape the housing during casting operations. A prime mover is provided for imparting a centrifugal force on the molten metal, and an arm is coupled to the prime mover adjacent to a proximate end to be rotated about a rotational axis and to support a cradle for receiving the mold adjacent to a distal end. A crucible is to be coupled to the arm for supporting the molten metal to be cast into the mold, and a catch surface is disposed between the arm and the bottom surface of the housing to collect molten metal that is cast but not received within the mold.

According to another aspect, the present invention provides a centrifugal casting apparatus for casting molten metal into a mold. The casting apparatus comprises a base for supporting the centrifugal casting apparatus; a housing comprising a retaining wall for minimizing a number of projectiles that escape the housing during casting operations; a prime mover for imparting a centrifugal force on the molten metal; and an arm coupled to the prime mover adjacent to a proximate end to be rotated about a rotational axis, the arm supporting a cradle for receiving the mold adjacent to a distal end. A crucible is to be coupled to the arm for supporting the molten metal to be cast into the mold, and a catch surface disposed between the arm and base to collect molten metal that is cast but not received within the mold.

According to another aspect, the present invention provides a method of minimizing a loss of metal experienced during a casting operation. The method comprises the steps of melting the metal in a crucible coupled to a rotational arm, imparting a centrifugal force onto the molten metal in the crucible to cast the molten metal into a suitably-positioned mold, and catching metal that has been cast but not received in the mold within a distance of about 24 inches or less from the arm.

DETAILED DESCRIPTION OF ILLUSTRATIVE EMBODIMENTS

Figure 1:
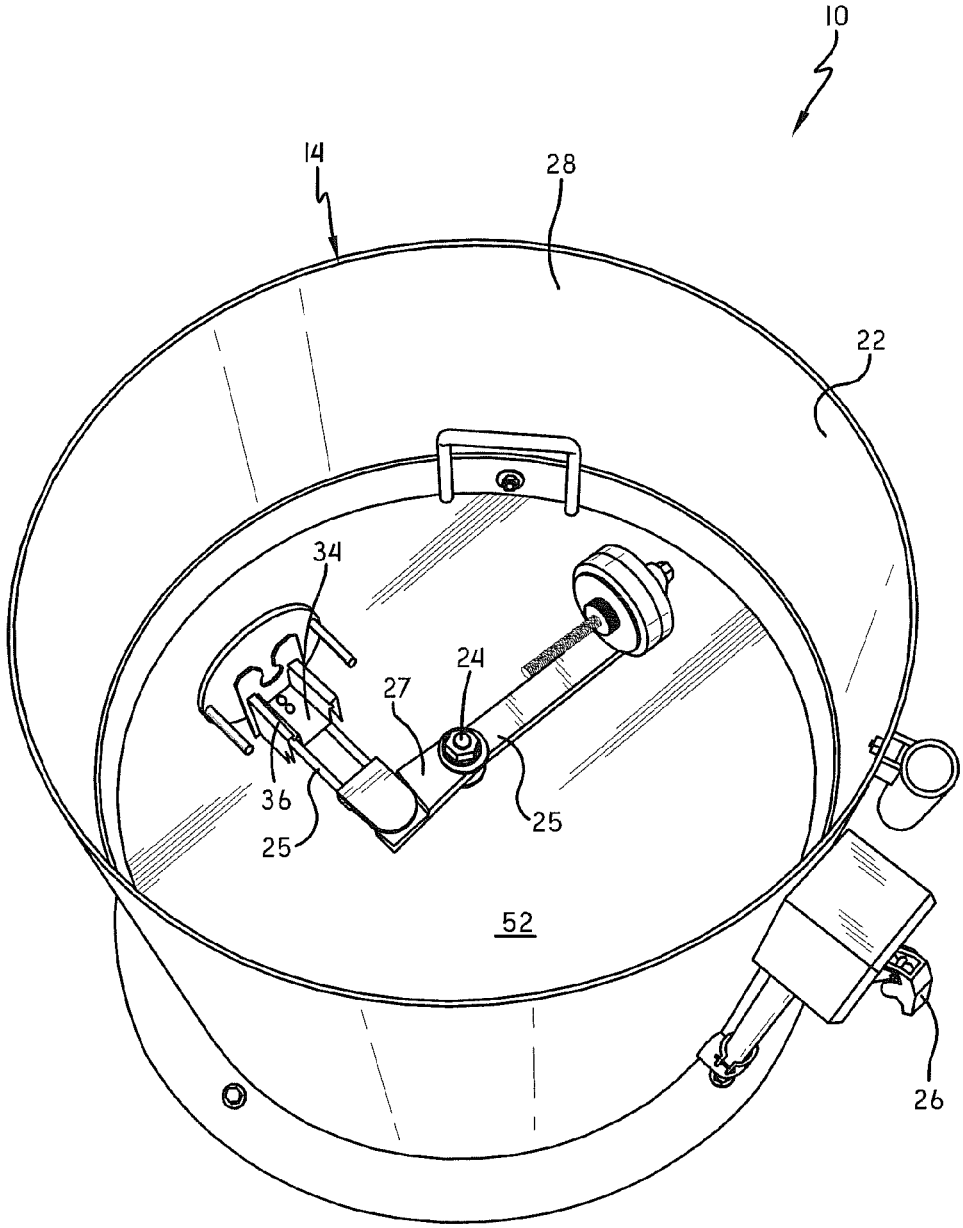
FIG. 1 is a top view into a casting apparatus according to an embodiment of the present invention.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

FIG. 1 illustrates a centrifugal casting apparatus according to an embodiment of the present invention for casting molten metal into a mold. Although the casting apparatus 10 can be used in a variety of applications, it is described herein with reference to an application for casting a prosthetic dental product such as a denture. As shown, the casting apparatus 10 includes a generally-cylindrical housing 14 with a bottom or lowermost surface 18, and a retaining wall 22 for minimizing a number of projectiles that escape the housing 14 during casting operations. In addition to being generally-cylindrical, the housing 14 can optionally be of any shape, such as rectangular, octagonal, and the like. Further, the housing 14 can be made of any generally-rigid material having suitable strength to withstand an impact from a projectile that breaks free during a casting operation and prevents that projectile from exiting the housing 14 where it could injure a bystander.

Figure 2A:
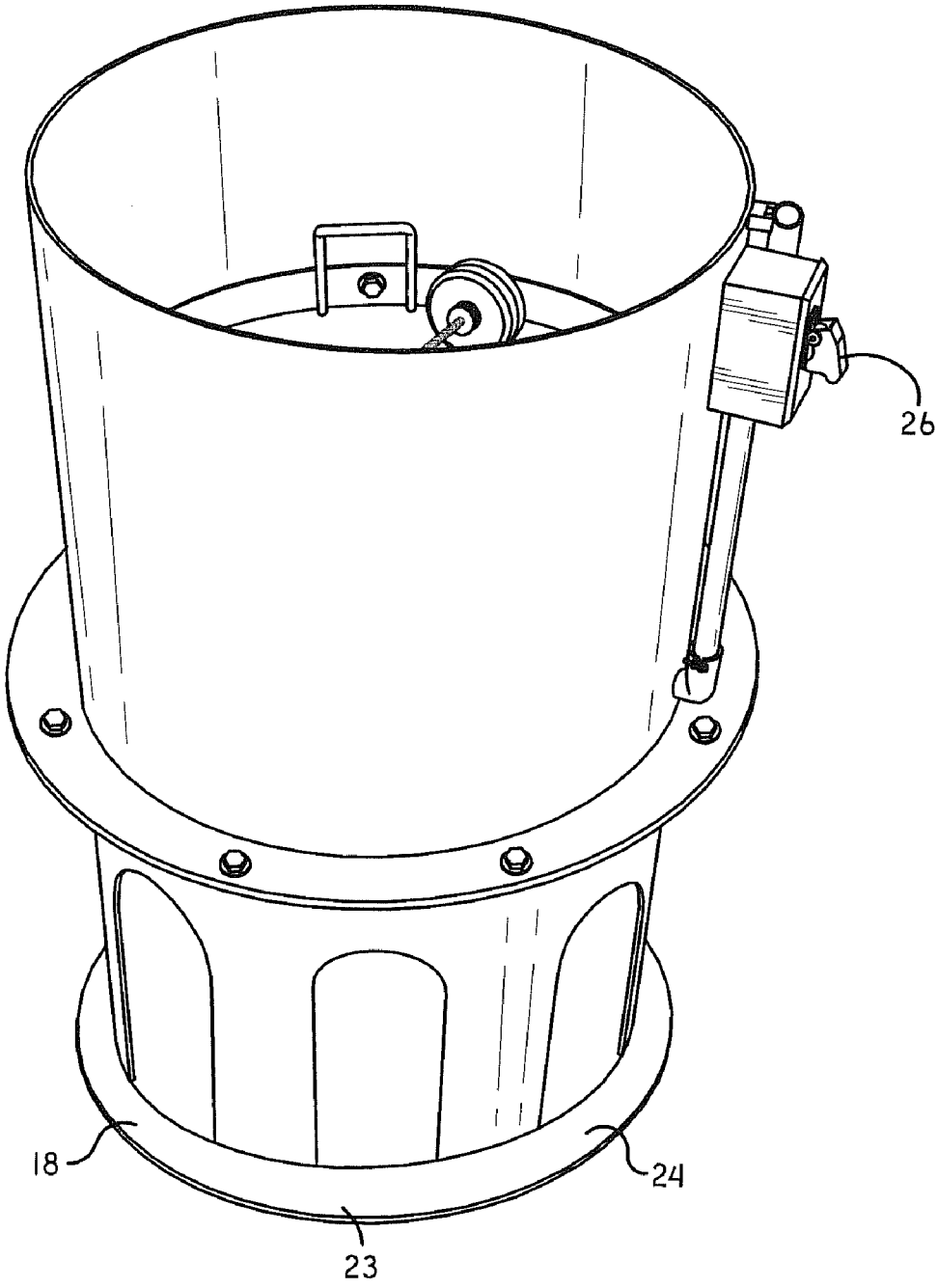
FIG. 2A is a perspective view of an embodiment of a casting apparatus.

The bottom or lowermost surface 18 of the casting apparatus 10 can be a generally-circular bottom of the cylindrical housing 14, for example, or it can be a lowermost surface of a stand 23 (shown in FIG. 2A) used to elevate the casting apparatus 10. The bottom surface 18 is also not necessarily planar, although such embodiments are within the scope of the present invention. Instead, the bottom surface 18 can be an annular surface of a flange 24, for example, such as that on which the casting apparatus 10 shown in FIG. 2A rests.

A prime mover such as an electric motor 30 (FIG. 6) or spring is provided, optionally within the housing 14, to rotate an arm 25 on which a molten metal is supported for imparting a centrifugal force on that molten metal. Operation of the prime mover can be initiated and terminated with a switch 26, for example, or other circuit control device provided to the casting apparatus 10. A proximate end 27 of the arm 25 is coupled to a shaft 29 rotated by the prime mover about an axis 32 to transmit the rotational motion of the shaft 29 to the arm 25. A system of gears or other drive-ratio adjusting devices can be used as desired to adjust the angular velocity of the arm 25 relative to that of the prime mover. To further minimize the ejection of projectiles from the housing 14, the arm 25 and features coupled thereto can be recessed within the housing 14, lower than an uppermost portion 28 of the housing 14.

Figure 2B:
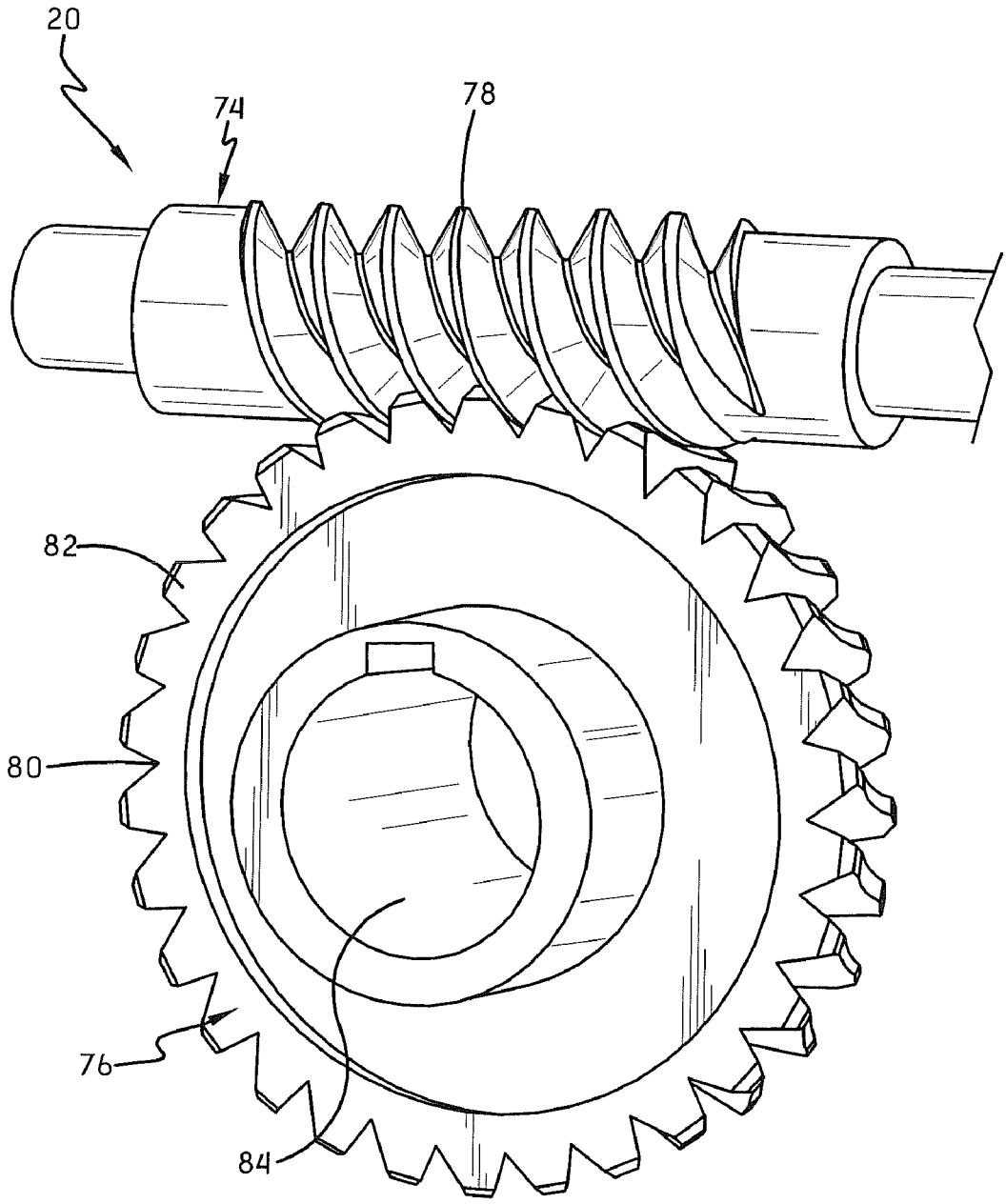
FIG. 2B is a perspective view of the cooperation of a worm gear set for transmitting the rotational force from an electric motor to an arm supporting a mold.

An example of a suitable set of gears 20 for transmitting the rotational force generated by an electric motor 30 to rotate the shaft 29 is shown in FIG. 2B. The set of gears 20 includes a worm 74 that cooperates with a circular gear 76. Shallow teeth 78 form a continuous spiral pattern in a longitudinal direction along the body of the worm 74. These teeth 78 fit into recesses 80 between teeth 82 formed about the circumference of the gear 76. As the worm 74 is rotated by the electric motor 30, the teeth 78 of the worm 74 create an endless spiral pattern, thereby forcing the teeth 82 of the gear 76 in the direction that the endless spiral appears to travel. This causes rotation of the gear 76, which in turn, rotates the shaft 29, which extends through an aperture 84 in the gear 76. The shaft 29 can optionally include a single tooth extending longitudinally along the length of the shaft 29 to fit within a notch 86 formed in the gear 76 to minimize slippage between the gear 76 and the shaft 29. Thus, rotation of the gear 76 by the worm 74 causes rotation of the shaft 29, and in turn, the arm 25 coupled to the shaft 29 and the mold in which the molten metal is to be shaped.

Figure 2C:
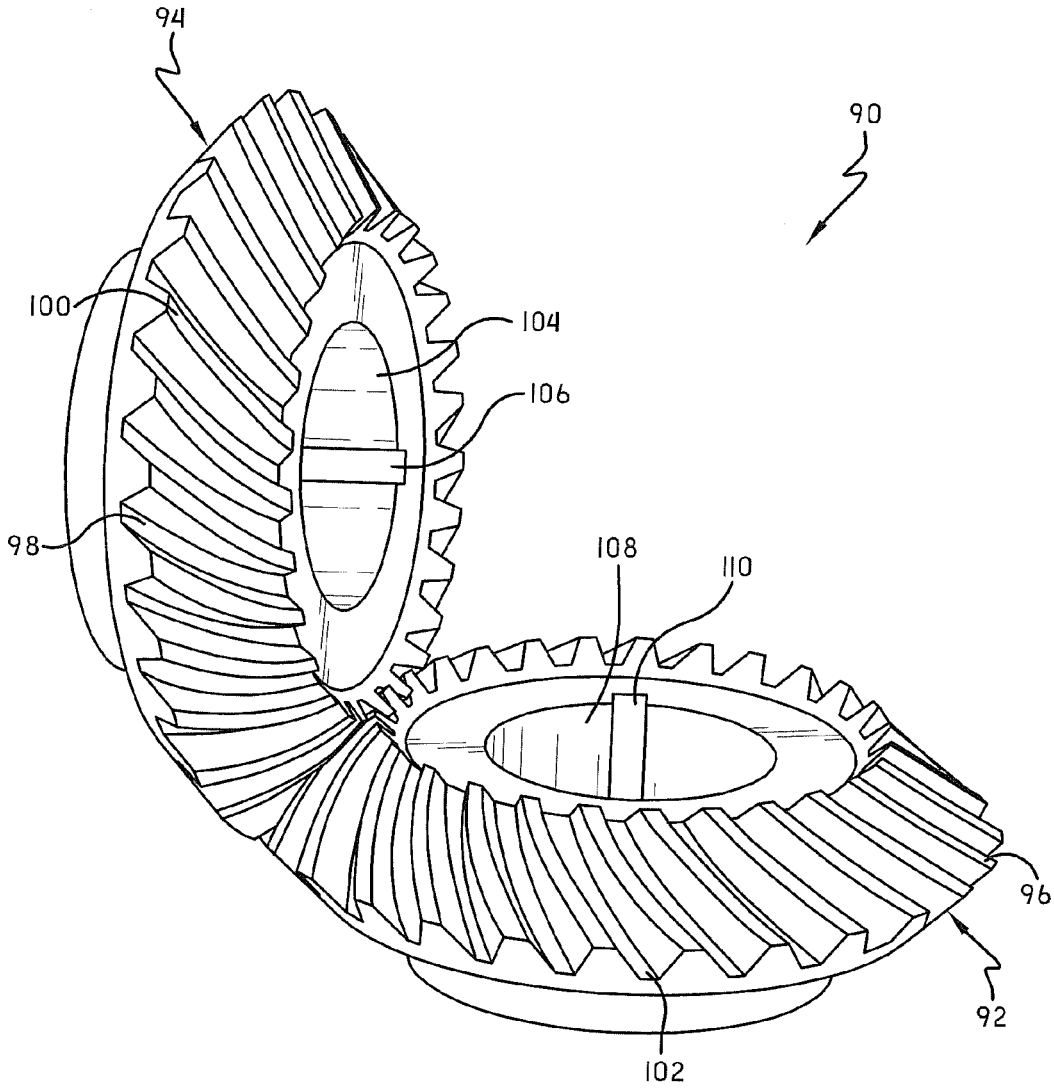
FIG. 2C is a perspective view of the cooperation of bevel gears having a gear ratio of approximately 1:1 for transmitting the rotational force from an electric motor to an arm supporting a mold.

An example of another suitable set of gears 90 for transmitting the rotational force generated by an electric motor 30 to rotate the shaft 29 is shown in FIG. 2C. The set of gears 90, commonly referred to as bevel gears, includes a generally horizontal gear 92 that cooperates with a generally vertical gear 94 to transmit the rotational force from the electric motor 30 to a shaft that is approximately perpendicular to the drive shaft of the electric motor 30. Although the gears 92, 94 of the embodiment shown in FIG. 2C are arranged at a right angle relative to each other, other angular orientations are also within the scope of the invention. Teeth 96 of the horizontal gear 92 fit within recesses 98 between the teeth 100 of the vertical gear 94, and similarly, the teeth 100 of the vertical gear 94 fit within recesses 102 between the teeth 96 of the horizontal gear 92.

The drive shaft from the electric motor 30 is received within an aperture 104 in the vertical gear 94, with a longitudinal tooth of the drive shaft being placed within a notch 106 of the vertical gear 94 to prevent slippage between the drive shaft and the vertical gear 94. Such an arrangement allows the drive shaft of the electric motor 30 to be oriented horizontally, which also permits a horizontal orientation of the motor 30. The horizontal orientation of the motor 30 eliminates the need for gaskets dedicated to minimize leakage of lubricants and other fluids from the motor 30 that would otherwise be required if the motor 30 was oriented on end, with the drive shaft in a vertical orientation. Similar to the arrangement of the worm gear set 20 discussed above, the shaft 29 to which the rotatable arm 25 for supporting the mold 39 is coupled extends vertically through an aperture 108 in the generally-horizontal gear 92. Again, a longitudinal tooth (not shown) extending along the length of the shaft 29 can be inserted through a notch 110 formed in the horizontal gear 92 to minimize slippage therebetween. Thus, the electric motor's rotation of the drive shaft, and in turn the vertical gear 94, causes rotation of the horizontal gear 92 and the shaft about a vertical axis. Rotation of the shaft 29 rotates the arm 25 supporting the mold 39, thereby imparting a centrifugal force on the molten metal and forcing it into the mold 39 to be shaped.

Figure 2D:
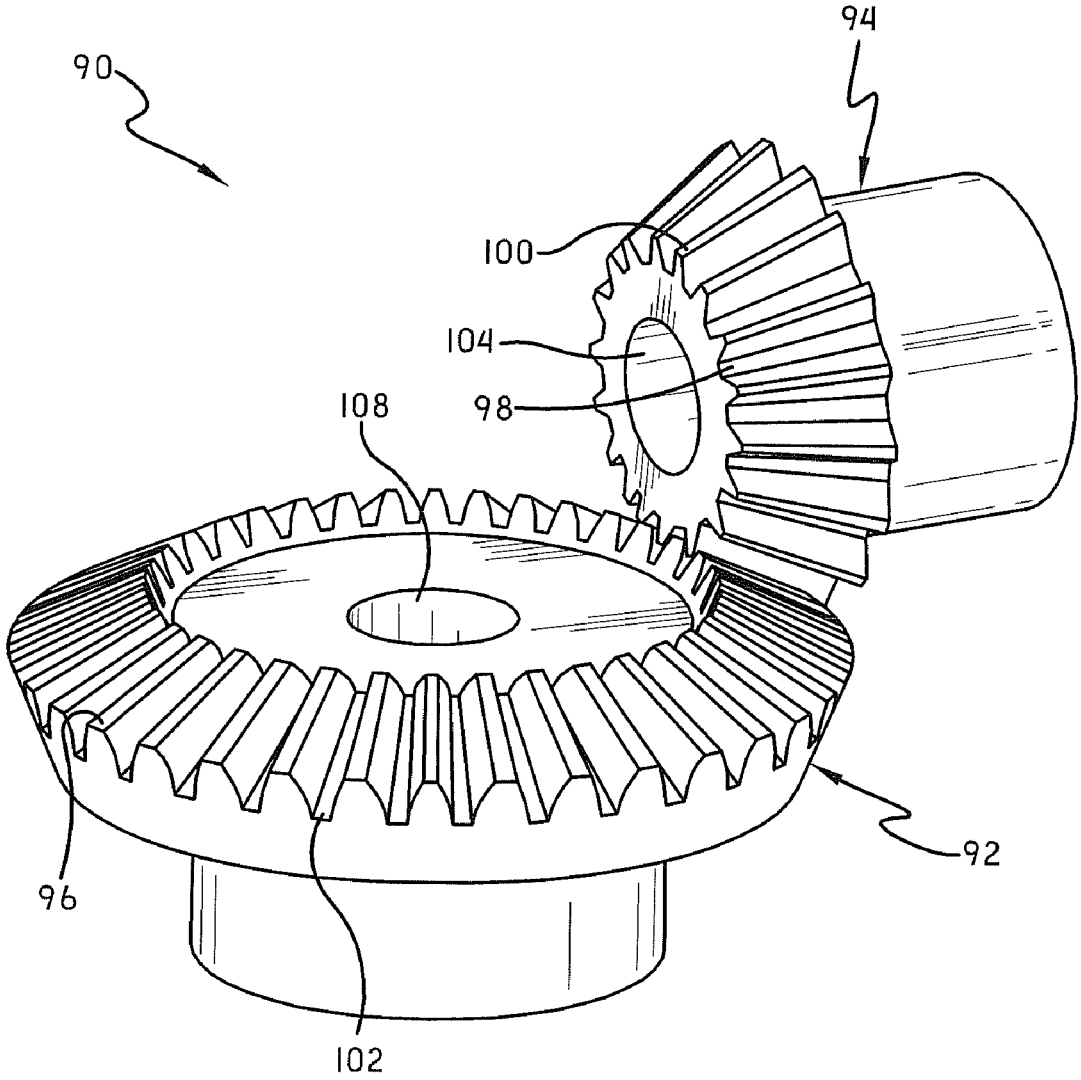
FIG. 2D is a perspective view of the cooperation of bevel gears having a gear ratio of less than 1:1 for transmitting the rotational force from an electric motor to an arm supporting a mold.

The embodiment of the bevel gear set 90 shown in FIG. 2C includes two bevel gears 92, 94 having approximately the same diameter, and therefore, a gear ratio of about 1:1. This is suitable for applications where the electric motor 30 can drive the drive shaft at an angular velocity at which the shaft 29 is to be rotated. The gear ratio of 1:1 means that the angular velocity of the vertical gear 94 will be about the same as the angular velocity of the horizontal gear 92. However, if it is desired to minimize the output torque required from the electric motor 30 or to rotate the arm 25 a an angular velocity other than that of the electric motor's drive shaft, a suitable gear ratio other than 1:1 can be utilized by gears 92, 94 having different diameters, but the same diametral pitch to ensure proper meshing. Such an arrangement is illustrated in FIG. 2D, where the vertical gear 94 (i.e., the drive or input gear), has a diameter less than the diameter of the horizontal gear 92 (i.e., the output gear). This arrangement will require the drive shaft from the electric motor 30 to rotate faster than the desired angular velocity of the horizontal gear 92, but will require less torque from the electric motor 30 to bring about this rotation of the horizontal gear 92. As shown in FIG. 2D, the vertical gear 94 has fewer teeth 100 than the horizontal gear 92, thus, the gear ratio is less than 1:1. For example, if it is assumed that the number of teeth 100 on the vertical gear 94 is half the number of teeth 96 on the horizontal gear 92, the gear ratio would be 1:2.

Figure 2E:
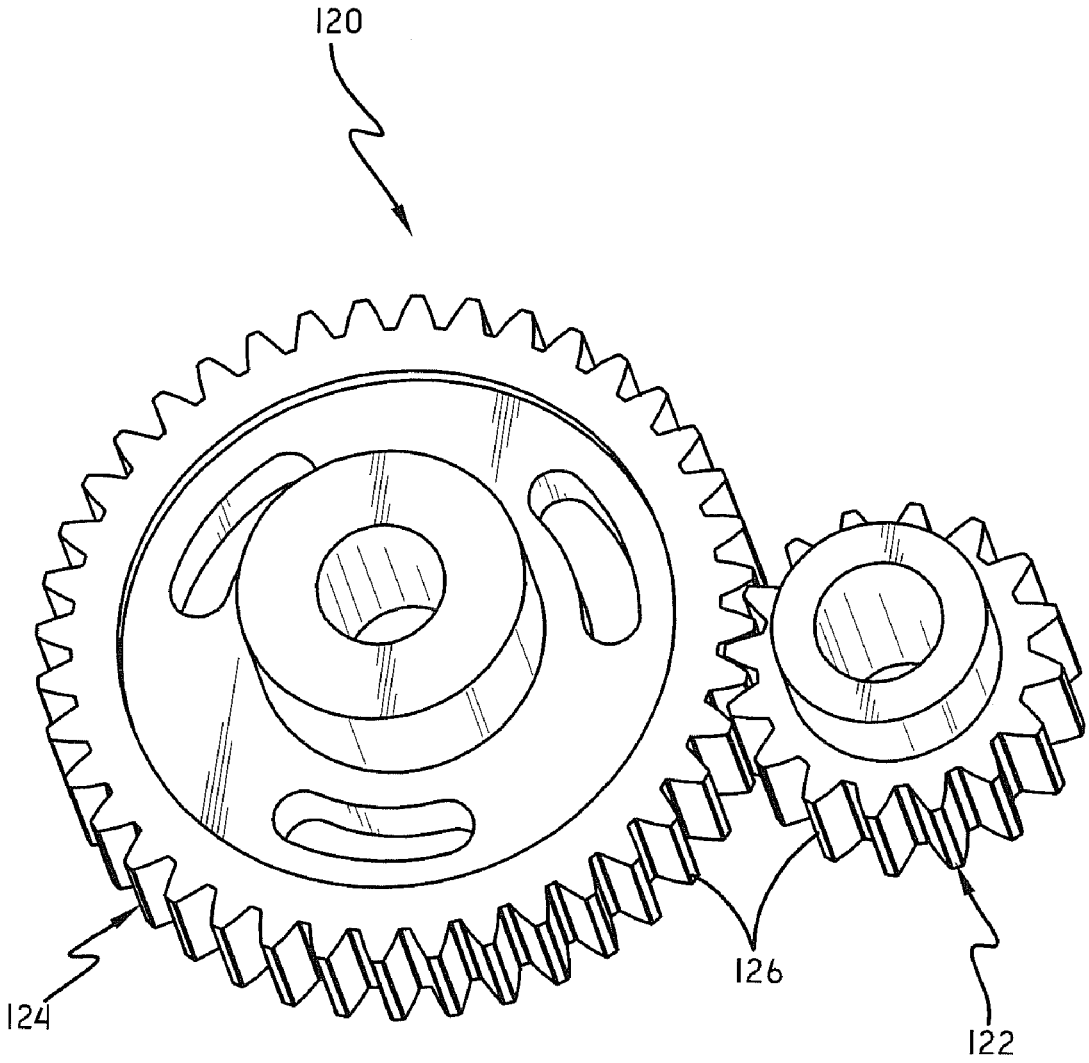
FIG. 2E is a perspective view of the cooperation of spur gears having a gear ratio of less than 1:1 for transmitting rotational force.

Alternate embodiments of the present invention can eliminate the need for a set of gears such as those discussed above for transmitting the rotational force of the electric motor 30 to a perpendicular shaft 29. For such embodiments, the electric motor 30 can be oriented such that the drive shaft of the motor 30 is generally parallel with the shaft 29 coupled to the arm 25 to bring about rotation thereof. Such an arrangement is referred to as a parallel-shaft configuration. The electric motor 30 in a parallel-shaft configuration is oriented such that the drive shaft extending through the motor 30 is generally vertical. Thus, the bearing supports for the drive shaft are also arranged vertically, and gravity acting on any lubricant or other fluids (collectively referred to as the "lubricants") within the motor 30 urges the lubricants toward the lowermost bearing. A gasket is installed adjacent to the lowermost bearing in the vertically-oriented electric motor 30 to minimize the seepage of the lubricants therefrom through the lowermost bearing. A set of spur gears 120 such as those shown in FIG. 2E can optionally be provided to vary the ratio of angular velocities of the electric motor's drive shaft and the shaft 29 for rotating the arm 25 that is to support the mold 39. The set of gears 120 can include at least two gears, a drive gear 122 to be coupled to the electric motor's drive shaft and an output gear 124 to be coupled to the shaft 29 of the casting device 10. And again, the gears 122, 124 can have the same number of teeth 126 or a different number of teeth 126, such as that shown in FIG. 2E, to vary the gear ratio between the two.

The different gear ratios discussed above can be any suitable gear ratio to rotate the arm 25 at a desired angular velocity about the shaft 29 for a given angular velocity of the electric motor's drive shaft driving rotation of the arm 25. For example, consider the set of gears shown in FIG. 2D. The electric motor's drive shaft rotates the vertical gear 94 and the shaft 29 is to be directly coupled to the horizontal gear 92. If the electric motor's drive shaft rotates at approximately 1750 revolutions per minute ("RPM") and the desired angular velocity of the shaft 29 (and thus, the arm 25) is 400 RPM, then a gear ratio of about 1 to 4.4 (i.e., 1750/400≈4.4) would be suitable. In other words, the vertical gear 94 rotated by the electric motor's drive shaft would rotate approximately 4.4 times faster than the horizontal gear 92 to which the shaft 29 is coupled. The gear ratio of the set of gears 92, 94 can be chosen with sound engineering judgment in view of the angular velocity of the electric motor's drive shaft to provide the shaft 29, and thus the arm 25, with a desired angular velocity. The desired angular velocity of the arm 25 can optionally be chosen to be about the same as one or more of the following angular velocities: 50 RPM, 100 RPM, 150 RPM, 200 RPM, 250 RPM, 300 RPM, 350 RPM, 400 RPM, 450 RPM, 500 RPM, 550 RPM, 600 RPM, 650 RPM, 700 RPM, 750 RPM, 800 RPM, 850 RPM, 900 RPM, or any other angular velocity required for a particular casting operation.

Suitable gear ratios of the direct drive system of the present invention, which do not necessarily correspond to the preceding list of angular velocities, include, but are not limited to, any gear ratio selected within the range of about 1:0.5 to about 1:15, inclusive. This range of acceptable gear ratios also includes all sub-ranges that fall therein. Thus, an example of an acceptable sub-range of suitable gear ratios falling within the range of about 1:0.5 to about 1:15 is about 1:2 to about 1:6. Any sub-range of gear ratios having a starting gear ratio and an ending gear ratio that both fall within the aforementioned range of about 1:0.5 to about 1:15 are considered to be within the scope of the present invention.

It is also noted that the angular velocity of the electric motor's drive shaft for rotating the horizontal gear 94 in the examples above can optionally be continuously variable. This means that the speed of rotation of the electric motor's drive shaft can be adjusted to any speed within a predetermined range of speeds through the use of a dimmer-like switch. The dimmer-like switch typically includes a rotatable knob that can vary the duty cycle of a pulse-width modulation control routine, for example. Other methods of variably adjusting the speed of the electric motor's drive shaft known in the art are also considered within the scope of the present invention.

Figure 3:
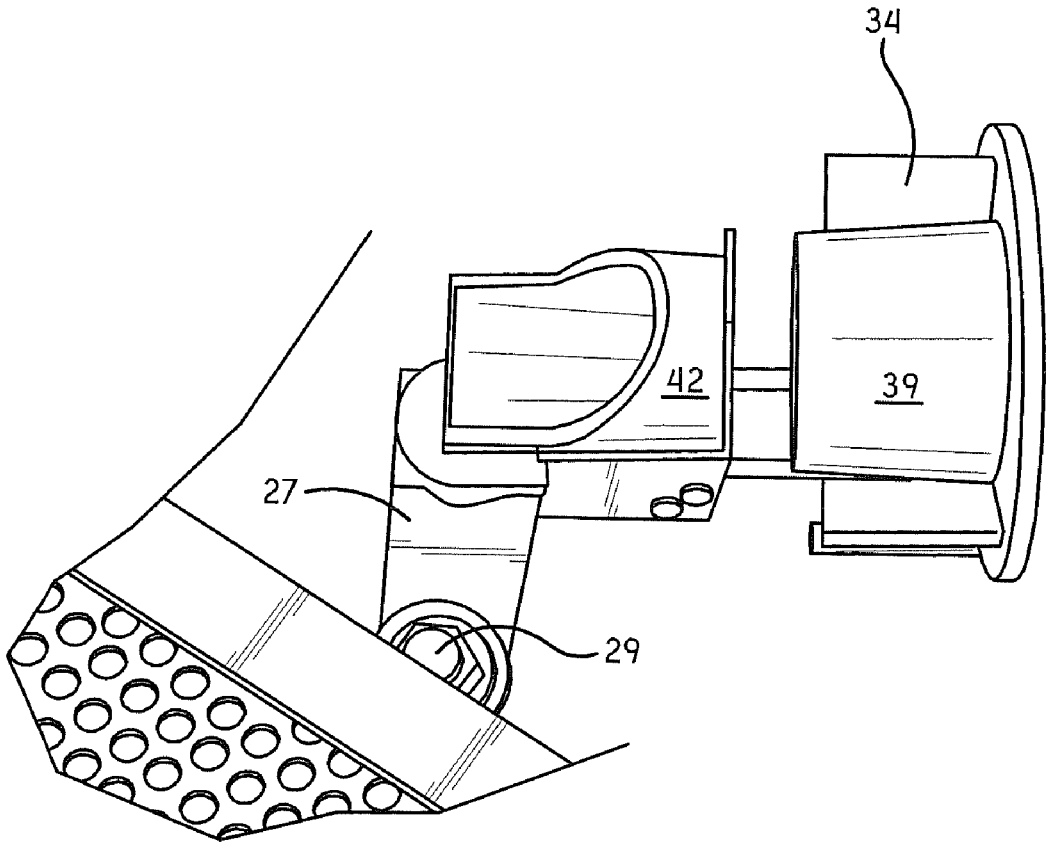
FIG. 3 is a top view of an embodiment of an arm supporting a mold and crucible according to the present invention.

A cradle 34 can be provided adjacent to a distal end 36 of the arm 25 to receive a mold 39 that is to be rotated about axis 32, as shown in FIG. 3. A crucible 42 can also be coupled to the arm 25 adjacent to the mold 39 for supporting the molten metal to be cast into the mold 39. Each of the mold 39 and the crucible 42 can independently be made from a material such as a ceramic that is resistant to high temperatures in excess of the melting temperature of the metal to be cast for a particular application. A source of thermal energy can optionally be provided to the casting apparatus 10 for melting the metal supported by the crucible 42. Also as shown in FIGS. 1 and 3, the arm 25 can be articulated, including a pivot point 45 at some point along the arm 25 between the cradle 34 and a counterweight provided to approximately balance the arm about the rotational axis 32. The pivot point 45 can be formed as overlapping arm portions with a pin 47 extended there through, however, other articulated arrangements are also within the scope of the present invention. The articulation allows a rapid angular acceleration of the arm 25 from rest to a desired angular velocity about the axis 32. As the arm 25 approaches the desired angular velocity, the centrifugal force from the arm's rotation causes the articulated portions of the arm 25 to form a generally linear structure as the arm 25 rotates at a constant angular velocity.

Figure 4:
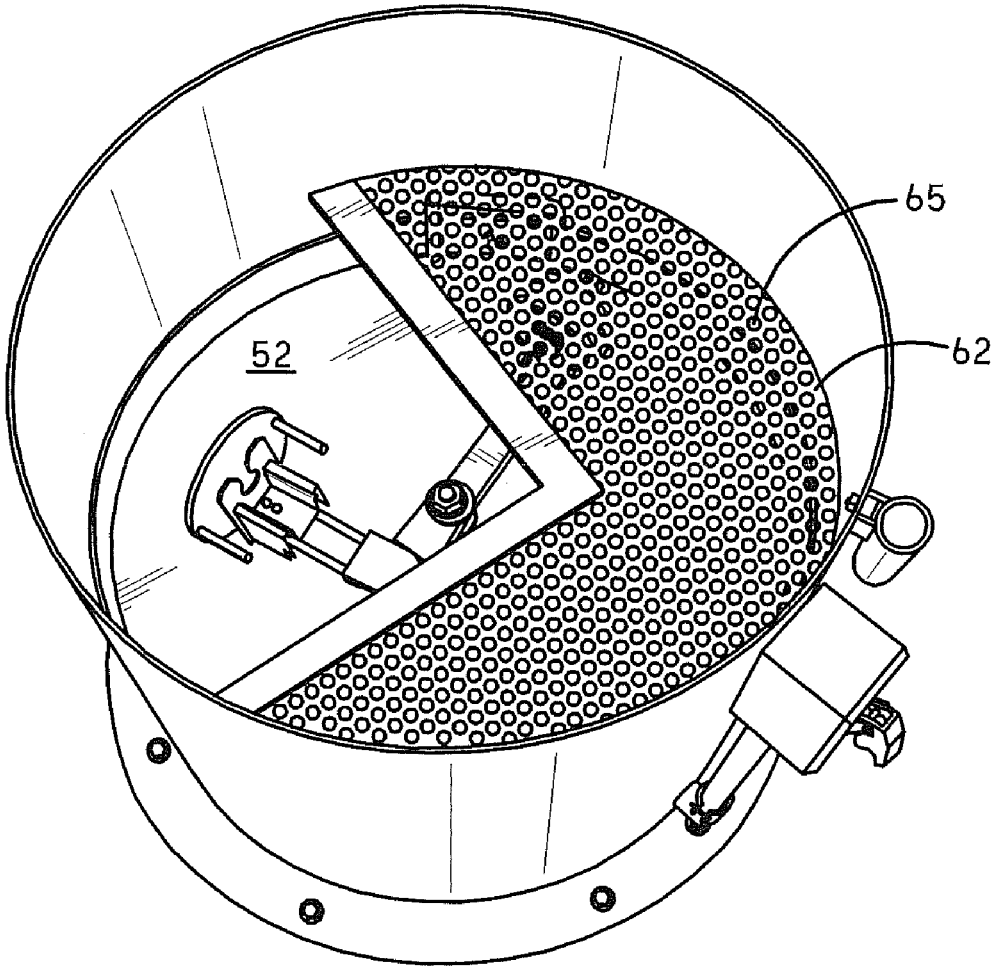
FIG. 4 is a perspective view of an embodiment of a casting apparatus including a safety fence.

FIGS. 1 and 4 illustrate a catch surface 52 that is disposed between the arm 25 and the bottom surface 18 of the housing 14 to collect molten metal that is cast but not received within the mold 39. The catch surface 52 can be a generally-planar, circular plate having a diameter that approximates the interior diameter of the cylindrical housing 14 of the illustrative embodiments. However, the catch surface 52 can have any shape that fits within the interior of the housing 14 to catch and collect metal cast from the crucible 42 but not received by the mold 39 as that metal falls under the influence of gravity. Other embodiments include a catch surface 52 that is shaped to funnel caught metal to a collection point, etc. . . .

The catch surface 52 is elevated above the bottom surface 18, as those relative terms are understood with reference to the Figures. The term "above" means that the catch surface 52 is positioned further from the ground 55, for example, that the casting apparatus 10 is resting on. In other words, the catch surface 52 is closer to the arms of an operator of the casting apparatus 10 as that operator stands upright adjacent to the casting apparatus 10, which is itself oriented in an upright orientation in which the casting apparatus 10 is to be operated. It follows that the catch surface 52 is closer to the arm 25 than the bottom surface 18 of the housing 14. Although the present invention includes any configuration where the catch surface 52 is closer to the arm than the bottom surface 18 of the housing 14, examples of specific embodiments include configurations where the arm 25 is separated from the catch surface 52 by a distance of: about 24 inches or less, about 20 inches or less, about 16 inches or less, about 12 inches or less, about 10 inches or less, about 8 inches or less, and about 4 inches or less.

Another way to view the relative position of the catch surface 52, the bottom surface 18, and the arm 25 is by expressing the relative positions with reference to an elevation above the bottom surface 18. Again, the present invention includes any spatial arrangement where the catch surface 52 is elevated above the bottom surface 18, but specific embodiments include a catch surface 52 supported at an elevation above the bottom surface 18 of the housing 14 that is about X inches less than the elevation of the arm 25 above the bottom surface 18. The variable X can be selected as any integer from about 1 to about 24, for example.

Other embodiments of the present invention elevate the casting apparatus 10 off of the ground. According to such embodiments, the casting apparatus includes a base for supporting the centrifugal casting apparatus and a housing comprising a retaining wall for minimizing a number of projectiles that escape the housing during casting operations. Just as before, a prime mover is provided for imparting a centrifugal force on the molten metal, and an arm is coupled to the prime mover adjacent to a proximate end to be rotated about the rotational axis. The arm supports a cradle for receiving the mold adjacent to a distal end, while a crucible is to be coupled to the arm for supporting the molten metal to be cast into the mold. For these embodiments, a catch surface is disposed between the arm and the base to collect molten metal that is cast but not received within the mold. According to these embodiments, however, the catch surface can be the bottom surface of the casting apparatus adjacent to the base that the casting apparatus is resting on.

Alternate embodiments further include a safety screen 62 such as that shown in FIG. 4 can be provided to limit access to the arm 25. The safety screen 62 can optionally include a plurality of apertures 65 that are too small for an adult finger to fit through. This protects the operator's limbs while still permitting observation of the arm 25 while in motion.

Figure 5:
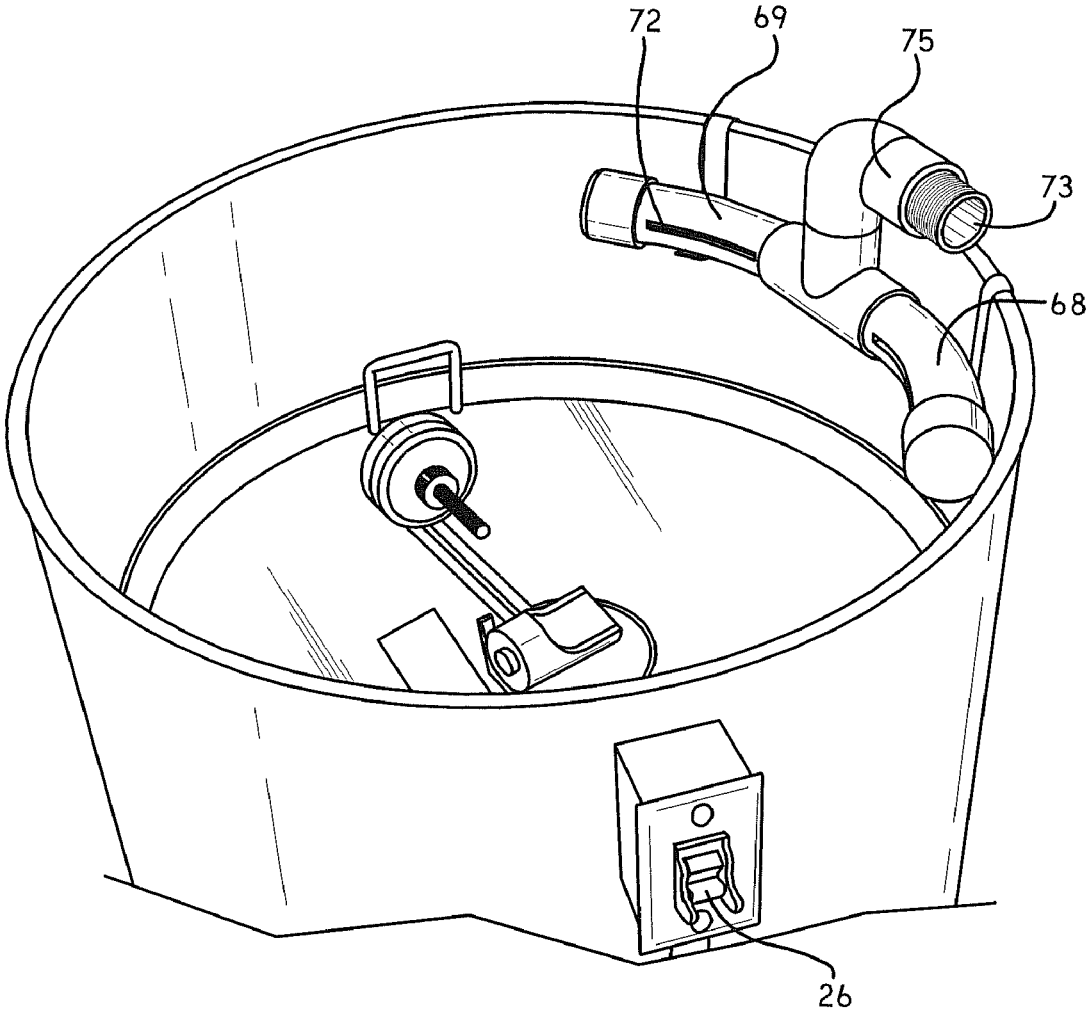
FIG. 5 is a perspective view of an embodiment of a casting apparatus equipped with a ventilation device of the present invention.

Alternate embodiments can optionally further include a ventilation device 68 shown in FIG. 5 for drawing vapors possibly emitted as a result of subjecting materials to the high temperatures of casting operations in a direction generally away from a user interface. The user interface includes any device, such as the switch 26 that is possibly operated by an operator in the course of operating the casting apparatus 10. In FIG. 5, the ventilation device 68 includes a hollow, tubular intake 69 extending in opposite directions at least partially about a periphery of the housing 14. A vacuum can be created at an aperture 72 formed in the intake 69 of the ventilation device 68 by connecting a pump, air compressor, vacuum, or any other suction device (not shown) to an aperture 73 formed in the stem 75 of the ventilation device 68 through which the vapors can be drawn. A hose (not shown) can extend between the suction device and the aperture 73. From there, the vapors can be passed through a filter (not shown) such as a HEPA filter and vented to an external environment away from the operator.

Figure 6:
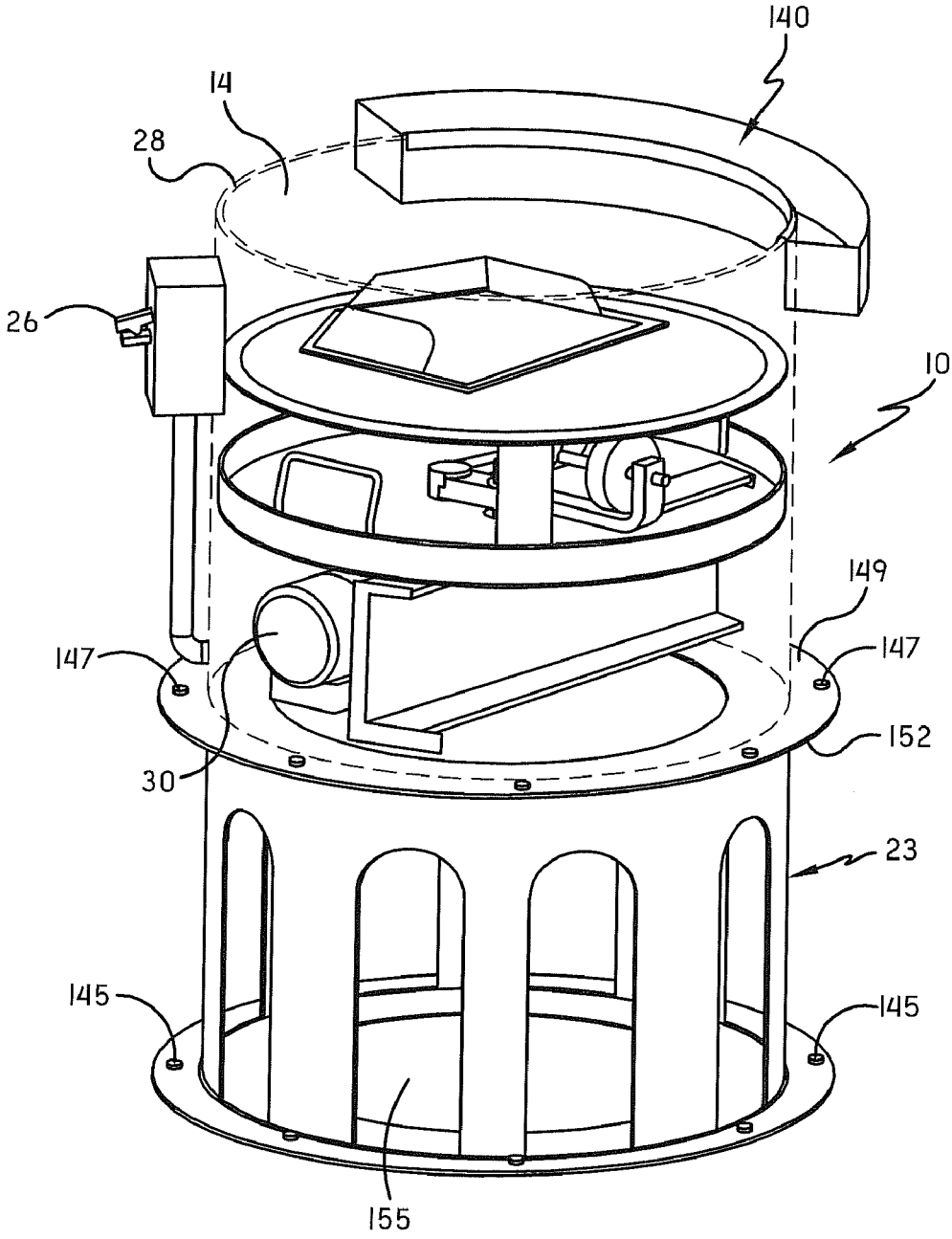
FIG. 6 is a perspective view of a casting device equipped with a well ring in accordance with an embodiment of the present invention.

A well ring 140 or other implement storing container can be provided about at least a portion of the exterior periphery of the housing 14 to store tools, casting molds, and other implements commonly used during casting operations. And embodiment of the well ring 140 is shown in FIG. 6 adjacent to the uppermost portion 28 of the housing 14. As shown, the well ring 140 is an arcuate container that extends about ⅓ of the circumference of the housing 14. A clip releasably couples the well ring 140 to the uppermost portion 28 of the housing 14. Although shown as an arcuate container, the well ring 140 can have any shape conducive to being coupled to the housing 14 of the casting device 10.

Also shown in FIG. 6 are apertures 145 formed in the flange 24 of the stand 23 upon which the casting device 10 can be supported. Fasteners such as screws, bolts, rivets, nails and the like can be inserted through the apertures 145 into a floor, countertop or other surface that the casting device 10 is placed on to minimize the need for ballasts to weight down the stand 23 and stabilize the casting device 10. Similar apertures 147 can optionally be formed in a flange 149 extending from at least a portion of the housing 14 and an upper flange 152 of the stand 23 for releasably coupling the housing 14 of the casting device 10 to the stand 23. The stand also defines a cavity 155 in which small items can be stored, and in which ballasts can be placed to provide enhanced stabilization to the casting device 10 when fasteners are not inserted through the apertures 145 to secure the casting device 10 to the floor or other support surface.

In use, a method of the present invention includes the steps of melting the metal in a crucible coupled to a rotational arm, imparting a centrifugal force onto the molten metal in the crucible using a direct drive mechanism including a set of gears and without a chain, belt, and the like, to cast the molten metal into a suitably-positioned mold, and catching metal that has been cast but not received in the mold within a distance of about X inches or less from the arm. The distance represented by X is considered an altitude, generally parallel with the direction of gravity, beneath the arm 25. Just as before, X can be any integer ranging from about 1 to about 24. Specific embodiments include values of X to be 20 inches or less, 16 inches or less, 12 inches or less, 8 inches or less, 4 inches or less, or any other distance. Further, the method can optionally also include the step of drawing vapors from casting operations in a direction generally away from a user interface. This is performed with the ventilation device 68 described herein.

Illustrative embodiments have been described, hereinabove. It will be apparent to those skilled in the art that the above devices and methods may incorporate changes and modifications without departing from the general scope of this invention. It is intended to include all such modifications and alterations in so far as they come within the scope of the appended claims.

What is claimed is:

1. A casting apparatus for casting molten metal into a mold, the casting apparatus comprising:

a top loadable cylindrical housing defining an interior housing region, said cylindrical housing comprising a top opening adapted for passage of materials therethrough between the environment and the interior housing region, a bottom surface, and a circumferential retaining wall, adapted to minimize the number of projectiles that escape the housing during casting operations;

a stand adapted to elevate the housing above the ground, the stand comprising an upper surface engaged with the bottom surface of the housing, and a lower surface adapted for engagement with the ground;

an electric motor, said motor comprising a rotatable drive shaft adapted to rotate and to impart rotation to objects engaged therewith, said motor engaged with the housing within the interior housing region, such that the rotatable drive shaft is horizontal;

a switch adapted to selectably supply electrical power to the electric motor;

a switch adapted to selectably adjust the angular velocity of the drive shaft within a continuously variable range;

a system of bevel gears within the interior housing region comprising, a vertical bevel gear adapted to rotate about a horizontal axis, and engaged with the electric motor and adapted to be rotated thereby, a horizontal bevel gear adapted to rotate about a vertical axis, and engaged with the vertical bevel gear and adapted to be rotated thereby;

where the gear ratio between the vertical bevel gear and the horizontal bevel gear is between about 1:0.5 to 1:15;

an elongated output shaft within the interior housing region, said elongated output shaft engaged to said horizontal bevel gear and adapted to be rotated thereby, oriented such that the axis of elongation of the output shaft is vertical, and being adapted to rotate about its own axis of elongation;

an arm within the interior housing region, said arm engaged to the output shaft and adapted to be rotated thereby, said arm rotatable about the axis of elongation of the output shaft, said arm comprising a counterweight adapted to rotationally balance the arm, said arm comprising an articulation, said articulation comprising a joint pivotable about a vertical pivot axis;

said joint formed from overlapping arm portions with a pin extending therethrough;

a screen defining a barrier between the top opening and the arm, said screen comprising, a plurality of apertures;

a ventilation device comprising, a hollow tubular intake extending at least partially around the housing, a suction device, and a HEPA filter;

an implement storage container engaged with the exterior periphery of the housing;

a stabilizer comprising a fastener adapted to engage the stand to the ground;

a cradle engaged to the arm, said cradle adapted to receive a mold for a dental prosthesis, a crucible engaged to said arm, said crucible adapted to support molten metal to be cast into the mold; and a catch surface disposed between the arm and the bottom surface of the housing, said catch surface adapted to collect molten metal that is cast but not received within the mold, said catch surface being a generally planar, circular plate of a diameter that approximates the interior diameter of the interior housing region of the cylindrical housing.

* * * * *